US008747565B1

(12) United States Patent
Arian et al.

(10) Patent No.: US 8,747,565 B1
(45) Date of Patent: Jun. 10, 2014

(54) WATERCRAFT SURFACE CLEANING DEVICE AND ASSOCIATED METHODS

(75) Inventors: Michael M. Arian, Punta Gorda, FL (US); Walter F. Trzaskus, New Smyrna Beach, FL (US); Mark Tripp, Clermont, FL (US)

(73) Assignee: First-In, LLC, New Smyrna Beach, FL (US)

( * ) Notice: Subject to any disclaimer, the term of this patent is extended or adjusted under 35 U.S.C. 154(b) by 820 days.

(21) Appl. No.: 12/477,807

(22) Filed: Jun. 3, 2009

Related U.S. Application Data

(60) Provisional application No. 61/058,306, filed on Jun. 3, 2008.

(51) Int. Cl.
*B63B 59/08* (2006.01)
*B63B 59/06* (2006.01)

(52) U.S. Cl.
USPC ..... 134/6; 114/222; 294/191; 15/236.07

(58) Field of Classification Search
CPC ..... B63B 59/08; B63B 59/06
USPC ..... 114/222; 134/6; 294/191; 15/236.07
See application file for complete search history.

(56) References Cited

U.S. PATENT DOCUMENTS

| | | | | |
|---|---|---|---|---|
| 630,261 | A | 8/1899 | McLane | |
| 2,443,602 | A * | 6/1948 | Clark | 15/401 |
| 3,251,331 | A | 5/1966 | Crawford | |
| 3,628,489 | A | 12/1971 | Michaelsen | |
| 3,707,737 | A | 1/1973 | Brower | |
| 4,060,047 | A * | 11/1977 | Sabella | 114/222 |
| 4,314,521 | A | 2/1982 | Lundberg | |
| 4,407,213 | A * | 10/1983 | Evans | 114/222 |
| 4,682,558 | A | 7/1987 | Broersz | |
| 4,781,139 | A | 11/1988 | Burgers | |
| 4,833,799 | A * | 5/1989 | Harte et al. | 37/231 |
| 4,991,533 | A | 2/1991 | Sterling | |
| 5,209,176 | A | 5/1993 | Pompei et al. | |
| 5,333,348 | A * | 8/1994 | Schumacher et al. | 15/235.4 |
| 5,353,465 | A * | 10/1994 | Pierce et al. | 15/236.01 |
| 5,685,251 | A | 11/1997 | Halko | |
| 5,864,917 | A * | 2/1999 | Landsman | 15/246 |
| 5,951,781 | A * | 9/1999 | Lucas | 134/6 |
| 6,263,821 | B1 | 7/2001 | Hodder | |
| 6,394,706 | B1 | 5/2002 | Gentry | |
| 6,467,377 | B1 * | 10/2002 | Kersting | 81/45 |
| 6,488,572 | B1 | 12/2002 | Mason | |
| 6,668,413 | B2 * | 12/2003 | Fortier | 15/1.7 |

(Continued)

*Primary Examiner* — Michael Kornakov
*Assistant Examiner* — Katelyn Whatley
(74) *Attorney, Agent, or Firm* — Allen, Dyer, Doppelt, Milbrath & Gilchrist, P.A.

(57) ABSTRACT

A device for cleaning submergible surfaces includes a mandrel having a handle at a proximal end and a connector at a distal end. The handle can be removably mounted to an air tool. A cleaning tip holder has an opening at a distal end leading into an interior space. The cleaning tip holder can be connected with the mandrel connector and can be removably retained therewith. A cleaning tip includes a generally rectangular element having beveled front and side edges and can be removably retained partially within the cleaning tip holder interior space. In use, a cleaning tip is mounted in the cleaning tip holder interior space, and that combination is mounted to the mandrel connector. The mandrel handle is affixed to an air tool having an outlet hose, which, when activated, produces a reciprocating action in the device, creating a scrubbing action with the cleaning tip.

17 Claims, 3 Drawing Sheets

(56) References Cited

U.S. PATENT DOCUMENTS 8,104,811 B2 * 1/2012 Seguin et al. ..... 294/209
8,214,964 B1 * 7/2012 Coleman ..... 15/236.05
2004/0216307 A1 * 11/2004 Bitonto et al. ..... 30/279.6
2006/0011016 A1 * 1/2006 Potts ..... 81/15.9
2006/0118135 A1 * 6/2006 Griffith ..... 134/6
2008/0136904 A1 * 6/2008 Calsina ..... 348/81

* cited by examiner

WATERCRAFT SURFACE CLEANING DEVICE AND ASSOCIATED METHODS

CROSS-REFERENCE TO RELATED APPLICATION

This application claims the benefit of U.S. Provisional Application Ser. No. 61/058,306, filed on Jun. 3, 2008, the contents of which are hereby incorporated by reference in their entirety.

FIELD OF THE INVENTION

The present invention relates to devices and methods for cleaning exposed surfaces of watercraft, and, more particularly, to such devices and methods for removing barnacles and other growth from water-contacting surfaces such as hulls, seawalls and pilings.

BACKGROUND OF THE INVENTION

Structures having surfaces that are at least intermittently submerged in a body of water are susceptible to fouling by marine growth, which can include barnacles. These organisms secrete a substance that, when hardened, becomes extremely difficult to remove without damage to the surface itself, and ultimately can cause damage to paint, vehicle efficiency, and fuel usage.

The use of manual cleaning methods is very labor-intensive, and typically is performed by exposing the surface desired to be cleaned, such as by removing a boat from the water body, which can be difficult and expensive, depending upon location. Cleaning the surface in situ also presents difficulties, in that it can be problematic to obtain leverage while in the water, and such an effort can be dangerous and unpleasant, again depending upon location.

While many attempts have been made to address this problem, there still remains a need for an effective, efficient, and easy-to-use surface-cleaning device and method for use on at least intermittently submerged surfaces.

SUMMARY OF THE INVENTION

The present invention is directed to a device and method of manufacture and use for cleaning surfaces that are at least intermittently submerged. The device comprises a mandrel having an elongated handle at a proximal end and a connector at a distal end. The handle is adapted for being removably mounted in operative relation with an air tool. A cleaning tip holder comprises a generally "U"-shaped element having an opening at a distal end leading into an interior space bounded at a proximal end by a back wall and at a top and bottom by top and bottom walls, respectively. The cleaning tip holder is dimensioned for connection with the mandrel connector and has means for being removably retained therewith.

A cleaning tip comprises a generally rectangular element having beveled front and side edges and means for being removably retained partially within the cleaning tip holder interior space.

In use, a cleaning tip is mounted in the cleaning tip holder interior space, and that combination is mounted to the mandrel connector. The mandrel handle is affixed to an air tool, which, when activated, produces a reciprocating action in the device, thereby creating a scrubbing action with the cleaning tip.

Additionally, an air tool for submerged operation includes an air outlet connection attached to an air hose for removing exhausted air from the vicinity of the air tool. A check valve is arranged at an outlet of the air hose for preventing water entry.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
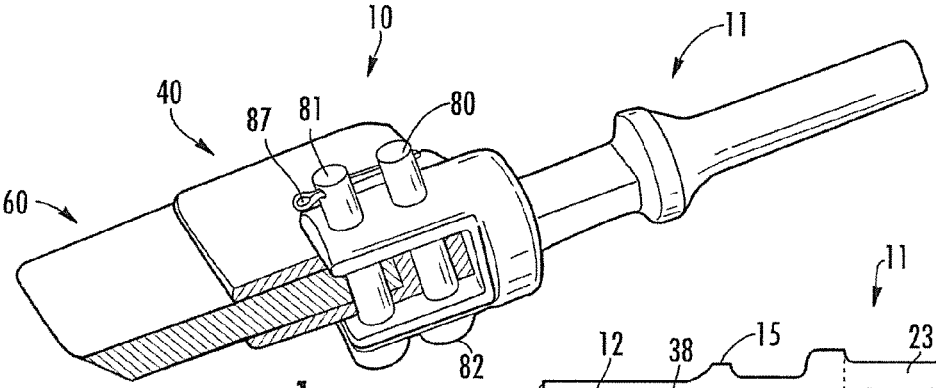
FIG. 1 is a partially cut-away side view of the cleaning device of the present invention.
Figure 2C:
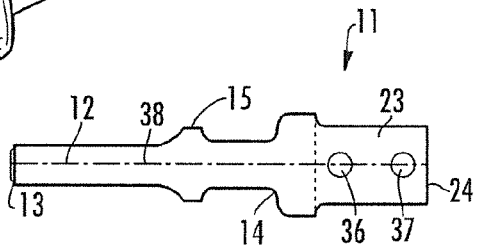
FIGS. 2A-2C are side, axial, and top plan views of the mandrel.
Figure 2A:
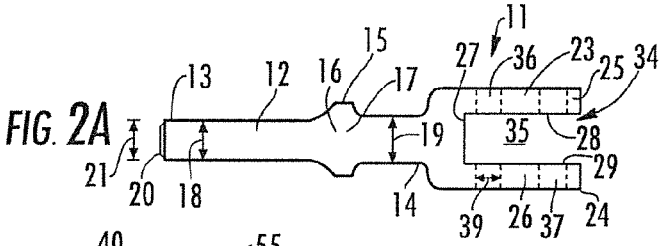
Figure 2B:
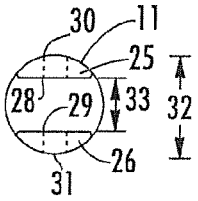
Figure 3A:
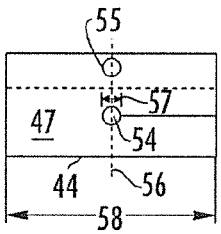
FIGS. 3A,3B are side cross-sectional and top plan views of the cleaning tip holder.
Figure 3B:
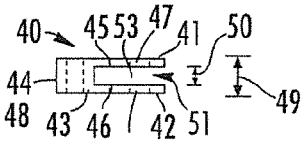
Figure 4A:
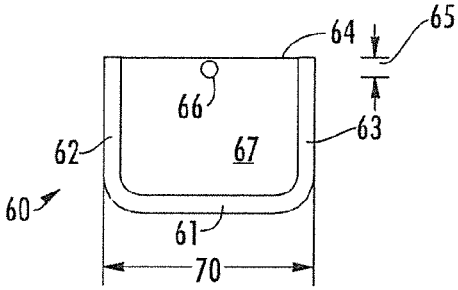
FIGS. 4A-4C are top plan, side cross-sectional, and front cross-sectional views of the cleaning tip.
Figure 4B:
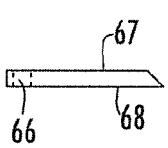
Figure 4C:
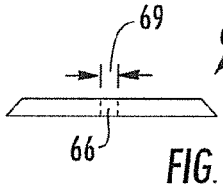
Figure 5:
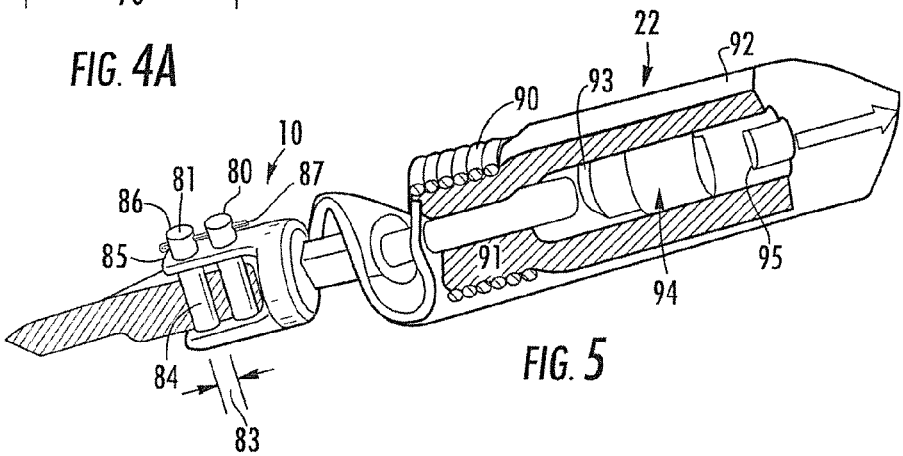
FIG. 5 is a side cut-away view of the device including a portion of an air tool.

A description of the preferred embodiments of the present invention will now be presented with reference to FIGS. 1-5.

The device 10 of the present invention (FIG. 1) is useful for cleaning surfaces that are at least intermittently submerged. The device 10 comprises a mandrel 11 (FIGS. 2A,2B) that has an elongated, substantially cylindrical handle 12 at a proximal end 13. Between the proximal end 13 and a distal end 14 of the handle 12 is a protrusion 15 that is upwardly sloped at a proximal side 16 and stepped at a distal side 17. The handle 12 has a first diameter 18 proximal of the protrusion 15 and a second diameter 19 distal of the protrusion 15, the second diameter 19 greater than the first diameter 18. Extending from the proximal end 13 is a substantially cylindrical end portion 20 that has a third diameter 21 less than the first diameter 18. The handle 12 is adapted for being removably mounted in operative relation with an air tool 22 (see FIG. 5).

The mandrel 11 also has a connector 23 at a distal end 24. The connector 23 comprises a generally "U"-shaped element having a top wall 25, a bottom wall 26, and a rear wall 27 connecting the top 25 and the bottom 26 walls, which are bulged adjacent the proximal end in a horizontal plane. The inner surfaces 28,29 of the top 25 and the bottom 26 walls are substantially planar, and the outer surfaces 30,31 thereof are sections of a circle, although none of these particular shapes are intended to be limiting. The connector 23 has an outer height 32 between the outer surfaces 30,31 and an inner height 33 between the inner surfaces 28,29. The inner surfaces 28,29, the rear wall 27, and an opening 34 at the distal end 24 define an inner space 35.

The connector 23 further has a pair of holes 36,37 extending through the top 25 and the bottom 26 walls. The holes 36,37 are substantially parallel and perpendicular to a longitudinal axis 38 of the handle 12 and have a diameter 39.

In a particular embodiment, the mandrel 11 can comprise hardened metal, such as, but not intended to be limited to, 4140 alloy steel, and can have a length of 4.25 in. The connector's inner height 33 can be 0.5 in, and the holes' diameter 39 can be 0.262 in. The first diameter 18 can be 0.394 in., a second diameter 19 of 0.460 in., and a third diameter 21 of 0.389 in. The mandrel 11 can be a commercially available unit insertable into the air tool 22.

A cleaning tip holder 40 (FIGS. 3A,3B) comprises a generally "U"-shaped element. The cleaning tip holder 40 comprises a top wall 41, a bottom wall 42, and a rear wall 43 at a proximal end 44 connecting the top 41 and the bottom 42 walls. Inner 45,46 and outer 47,48 surfaces of the top 41 and the bottom 42 walls are substantially planar and parallel to each other. The cleaning tip holder 40 has an outer height 49 between the outer surfaces 47,48 and an inner height 50 between the inner surfaces 45,46. The inner surfaces 45,46, the rear wall 43, and an opening 51 at a distal end 52 define an interior space 53. The outer height 49 is dimensioned for insertion into the mandrel connector's inner space 35, with the outer height 49 and the mandrel connector's inner height 33 approximately the same.

The cleaning tip holder 40 further has a pair of holes 54,55 extending through the top 41 and the bottom 42 walls. The holes 54,55 are substantially parallel and perpendicular to a longitudinal axis 56 of the cleaning top holder 40, have a diameter 57, and align with the mandrel connector's holes 36,37. The cleaning tip holder's top 41 and bottom 42 walls have a width 58 in a horizontal plane.

The cleaning tip holder 40 can also comprise hardened 4140 alloy steel, with a width 58 of 3.0 in. (a range of 2-8 in. is preferred), a length of 1.5 in., an outer height 49 of 0.5 in., and an inner height 50 of 0.25 in. The holes 54,55 have a diameter of 57 of 0.250 in.

A cleaning tip 60 (FIGS. 4A-4C) comprises a generally rectangular element having beveled front 61 and side 62,63 edges and a substantially flat rear edge 64. The cleaning tip 60 further has a height 65 approximately the same as the cleaning tip holder's inner height 50, so that the cleaning tip 60 can be inserted into the cleaning tip holder's interior space 53. The cleaning tip 60 additionally has a hole 66 extending therethrough from a top face 67 through to a bottom face 68, the hole having a diameter 69, and a width 70 approximately equal to the cleaning tip holder's width 58 in a horizontal plane.

The cleaning tip 60, which can comprise, for example, polycarbonate resin thermoplastic or other plastic, can have a width 70 of 3.0 in. (again, a preferred width range of 1-8 in.), a length of 2.225 in., a height 65 of 0.25 in., and a hole diameter 69 of 0.25 in. Preferably, the material of the cleaning tip 60 is sufficiently hard to perform its intended cleaning tasks, but sufficiently soft so as to avoid damaging the surface to be cleaned. The shape and dimensions can be varied, but the bevel in a particular embodiment is 45° and a 0.5-in. radius at the corners, which serves to avoid damaging the surface being cleaned.

The device 10 further has elements for releasably connecting the mandrel 11, the cleaning tip holder 40, and the cleaning tip 60 together. These elements comprise a proximal 80 and a distal 81 clevis pin, each having a widened bottom end 82 and a body diameter 83 dimensioned so that the clevis pin body 84 can pass through the holes 36,37; 54,55; 66 of the mandrel 11, the cleaning tip holder 40, and the cleaning tip 60. The proximal and the distal clevis pins 80,81 also each has a diametric bore 85 adjacent a top end 86 dimensioned for receiving a clevis pin retainer 87 therethrough.

The device 10 is assembled by inserting a cleaning tip 60 into the cleaning tip holder's interior space 53, so that the holes 54,66 align. That combination 40,60 is inserted into the mandrel connector's inner space 35. The clevis pins 80,81 are inserted through the respective distal holes 37,55 and proximal holes 36,54,66 and secured with the clevis pin retainer 87.

For use, the mandrel handle 12 is affixed to an air tool 22 (FIG. 5), which has a retainer spring 90 surrounding a distal portion 91 of the body 92 and extends over the mandrel handle's protrusion 15 to retain them in an interconnected relationship. The mandrel handle's end portion 20 can be contacted by the distal end 93 of the air tool's piston 94, which, when activated, moves within the air tool's bore 95 to produce a reciprocating action in the device 10, thereby creating a scrubbing action with the cleaning tip 60. The device 10 can be held at a 30° angle to the surface to be cleaned, placed against the base of the growth. The cleaning tip 60 in use becomes "self-sharpening," in that the abrasive elements at the surface being cleaned can act to sharpen the cleaning tip 60. The cleaning tip 60 can easily be replaced as needed.

In a particular embodiment, the air tool 22 can operate at an air pressure in a range of 30-70 psi, although this is not intended as a limitation.

Conventional air tools can be unsuitable for submerged operation. For instance, air exhausted from the air tool underwater generates copious bubbles which can obscure visibility. Additionally, it can be difficult to grasp and operate the air tool.

Figure 6:
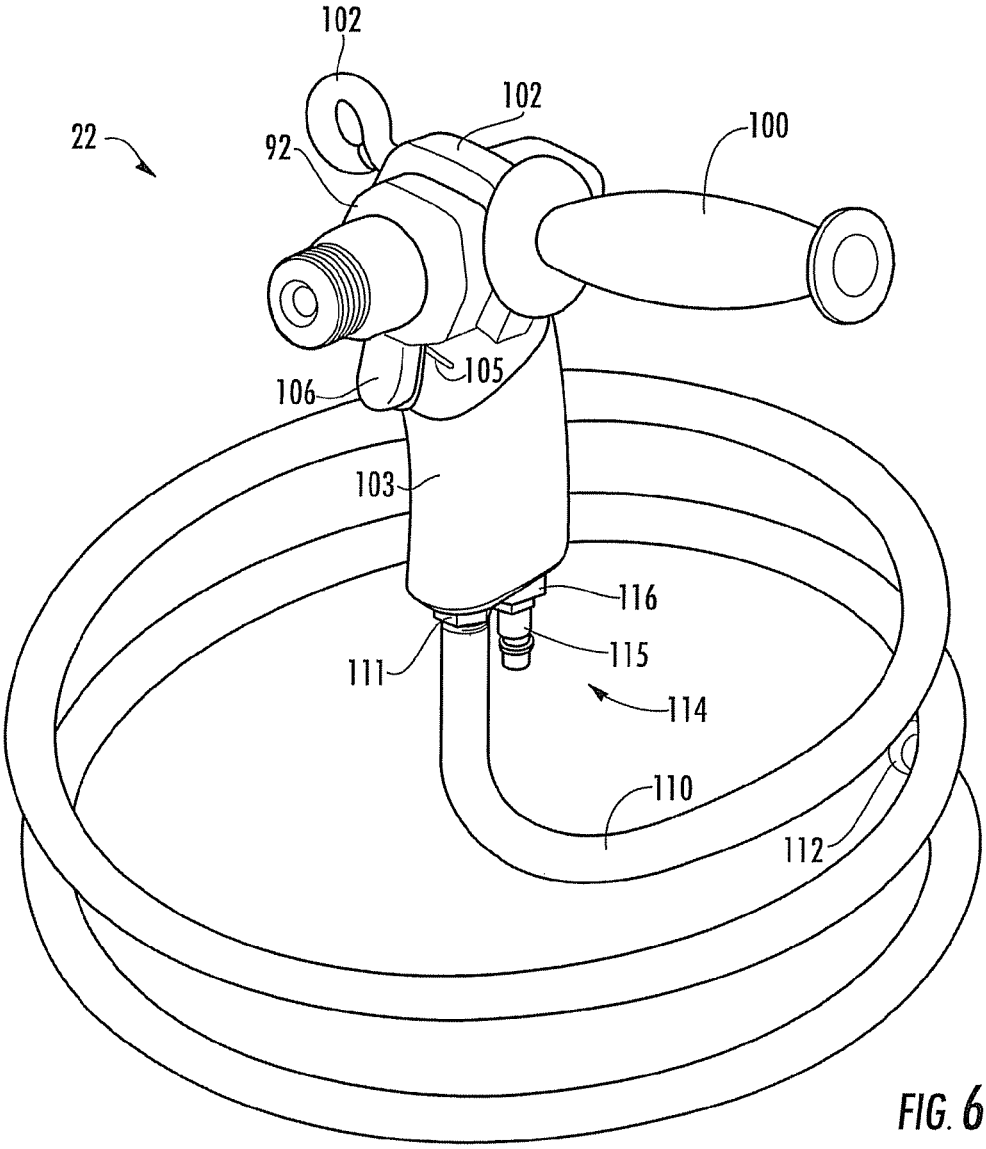
FIG. 6 is a perspective view of an air tool, according to an aspect of the present invention.
Figure 8:
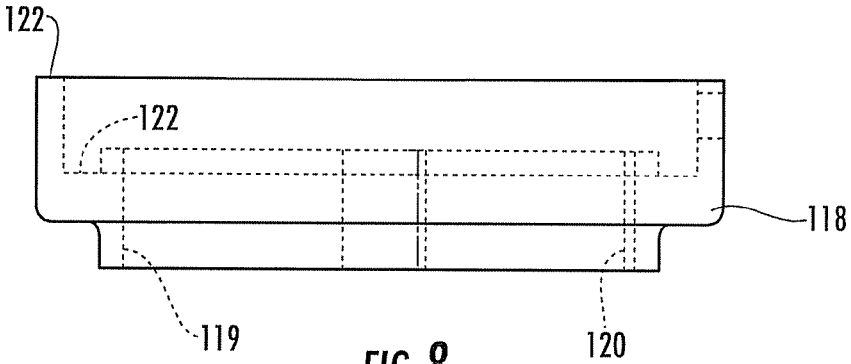
FIG. 8 is a side view of a component of the air tool of FIG. 6, with internal details shown in broken lines.
Figure 7:
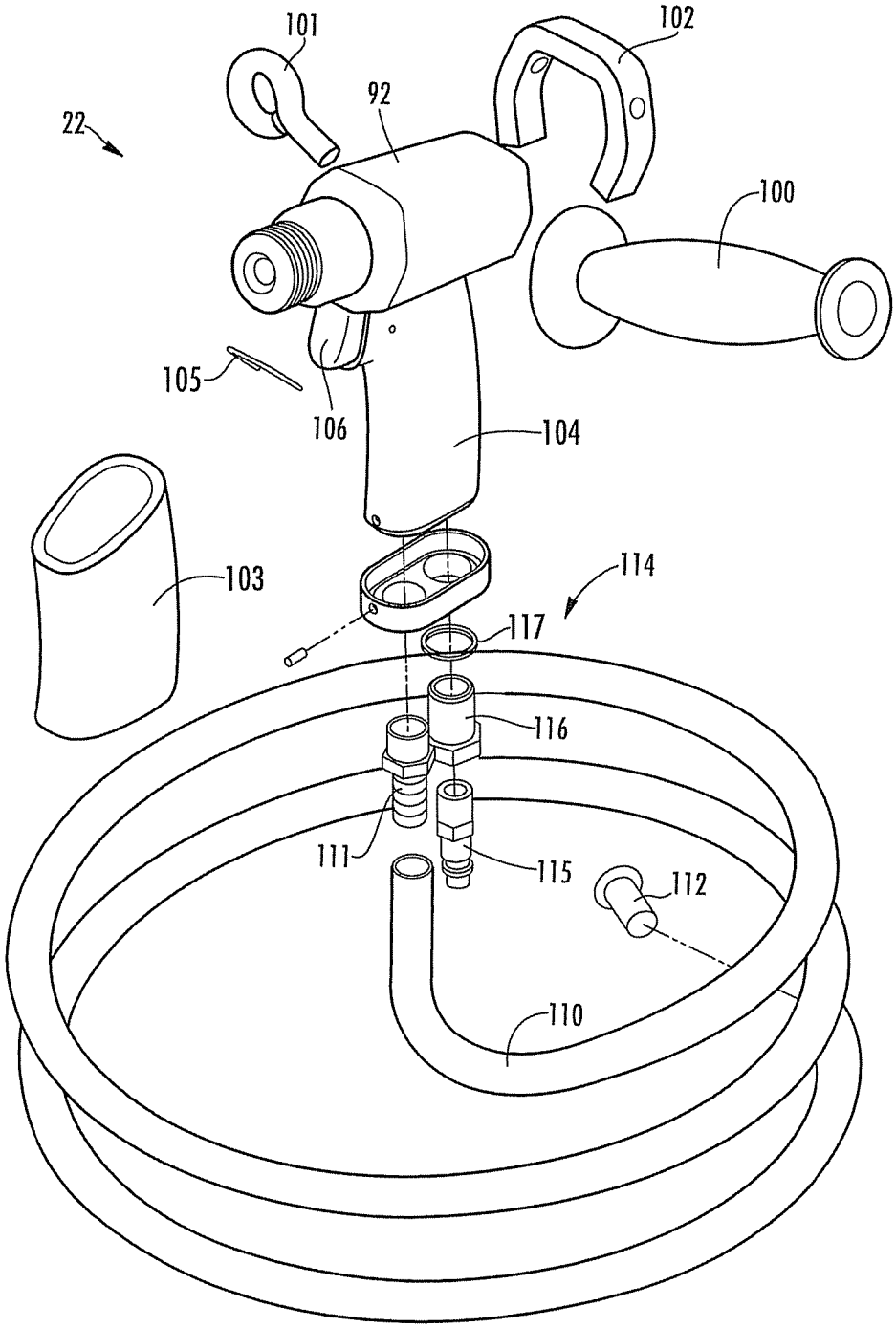
FIG. 7 is an exploded perspective view of the air tool of FIG. 6.

According to an additional aspect of the present invention, referring to FIGS. 6-8, the air tool 22 includes an auxiliary handle 100 and eye bolt 101 secured to the body 92 by a bar 102. A resilient grip 103, such as vibration dampening foam, is arranged over a handle portion 104 of the body 92, and a trigger lock 105 releasably secures a trigger 106 in an actuated position. The handle 100, grip 103 and lock 105 make it easier to comfortably hold and operate the air tool 22 in the underwater environment, while a lanyard or other attachment can be secured to the eye bolt 101 to prevent inadvertent loss of the tool 22 underwater.

To prevent bubbles from obscuring the visibility of a worker, an air outlet hose 110 is attached to an air outlet connection 111 of the air tool 22. The hose 110 leads the exhausted air well away from the worksite. A check valve 112 at the hose 110 outlet prevents water from being drawn into the air tool 22.

Advantageously, the air outlet connection 111 is part of a watertight air inlet/outlet assembly 114. The assembly 114 also includes an air inlet connection 115, air inlet spacer 116, washer 117, and inlet/outlet plate 118. The air inlet connection 115 is adapted for releasable connection to a standard air tool inlet house. The air/inlet outlet plate 118 (FIG. 8) defines air outlet and inlet holes 119, 120 positioned to align with corresponding air inlet and outlet conduits within the air tool 22. A pin 121 helps secure the plate 118 to the body 92.

The assembly 114 can be retrofit into existing air tools, in which case suitable watertight sealants are preferably applied around edges of the inlet/outlet plate 118 at locations 122 (FIG. 8). Alternately, an air tool can be purpose built for submerged operation, within various components made integrally with the tool or within sufficiently tight tolerances to prevent water intrusion during submerged operation.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention, is not limited to the exact details of construction.

What is claimed is:

1. A submerged surface cleaning device comprising:

a mandrel having an elongated handle and a connector at respective first and second ends thereof, the connector including a first generally U-shaped element;

a cleaning tip holder releasably mounted to the connector, the cleaning tip holder including a second generally U-shaped element;

a cleaning tip having at least one beveled edge releasably mounted to the cleaning tip holder;

wherein a portion of the cleaning tip is releasably accommodated in an open end of the first generally U-shaped element within an open end of the second generally U-shaped element, the first and second U-shaped elements and their respective open-ends being oriented in the same direction; and wherein the elongated handle is adapted for releasable connection to an air tool, such that the cleaning tip is reciprocatable by the air tool.

2. The device of claim 1, wherein aligned holes are defined through the connector, the cleaning tip holder and the cleaning tip and a clevis pin is removably inserted therethrough.

3. The device of claim 1, wherein the cleaning tip is plastic.

4. The device of claim 3, wherein the cleaning tip is polycarbonate resin thermoplastic.

5. The device of claim 3, wherein the mandrel and the cleaning tip holder are metal.

6. The device of claim 1, further comprising an air tool releasably connected to the elongated handle such that the cleaning tip is reciprocatable thereby.

7. The device of claim 6, wherein the air tool includes an air outlet connection adapted for connection of an air outlet hose thereto.

8. The device of claim 7, further comprising the air outlet hose connected to the air outlet connection.

9. The device of claim 1, wherein the first and second U-shaped elements each include a top wall, a bottom wall and a rear wall connecting the top and bottom walls.

10. The device of claim 1, wherein the mandrel includes a protrusion between the first and second ends.

11. The device of claim 10, wherein a first diameter of the mandrel between the protrusion and the first end is less than a diameter of the protrusion.

12. The device of claim 11, wherein the mandrel is sloped between the first diameter and the diameter of the protrusion.

13. The device of claim 11, wherein a second diameter of the mandrel between the protrusion and the second end is less than the diameter of the protrusion and greater than the first diameter.

14. The device of claim 5, wherein the mandrel and the cleaning tip holder are hardened metal.

15. The device of claim 14, wherein the hardened metal is a steel alloy.

16. A submerged surface cleaning device comprising:

a mandrel having an elongated handle and a connector at respective first and second ends thereof, the connector including a first generally U-shaped element;

a cleaning tip holder releasably mounted to the connector, the cleaning tip holder including a second generally U-shaped element;

a cleaning tip having at least one beveled edge releasably mounted to the cleaning tip holder;

wherein a portion of the cleaning tip is releasably accommodated in an open end of the first generally U-shaped element within an open end of the second generally U-shaped element;

wherein aligned holes are defined through the connector, the cleaning tip holder and the cleaning tip and a pin is removably inserted therethrough; and wherein the elongated handle is adapted for releasable connection to an air tool, such that the cleaning tip is reciprocatable by the air tool.

17. The device of claim 16, wherein a second set of aligned holes is defined through the connector and the cleaning tip holder, and a second pin is removably inserted therethough that does not extend into the cleaning tip.

* * * * *